US012024972B2

(12) United States Patent
Sequera et al.

(10) Patent No.: US 12,024,972 B2
(45) Date of Patent: Jul. 2, 2024

(54) HIGH EXPANSION BACKUP, SEAL, AND SYSTEM

(71) Applicants: Daniel Sequera, Houston, TX (US); Dennis Jiral, Katy, TX (US); Larry Urban, Santa Fe, TX (US); Chee Kong Yee, Katy, TX (US)

(72) Inventors: Daniel Sequera, Houston, TX (US); Dennis Jiral, Katy, TX (US); Larry Urban, Santa Fe, TX (US); Chee Kong Yee, Katy, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 120 days.

(21) Appl. No.: 17/674,983

(22) Filed: Feb. 18, 2022

(65) Prior Publication Data

US 2023/0265737 A1 Aug. 24, 2023

(51) Int. Cl.
*E21B 33/12* (2006.01)
*E21B 23/01* (2006.01)

(52) U.S. Cl.
CPC ..... *E21B 33/1216* (2013.01); *E21B 23/01* (2013.01)

(58) Field of Classification Search
CPC ..... E21B 33/1216
See application file for complete search history.

(56) References Cited

U.S. PATENT DOCUMENTS

| | | | | |
|---|---|---|---|---|
| 4,545,433 | A | 10/1985 | Wambaugh | |
| 5,054,163 | A * | 10/1991 | Sterling | E05D 7/0027 16/244 |
| 7,178,602 | B2 | 2/2007 | Hiorth et al. | |
| 7,896,085 | B2 | 3/2011 | Nutley et al. | |
| 9,670,747 | B2 | 6/2017 | Ruffo | |
| 10,487,614 | B2 | 11/2019 | Macdonald | |

(Continued)

FOREIGN PATENT DOCUMENTS

WO 2021003412 A1 1/2021

OTHER PUBLICATIONS

Merriam Webster Resister https://www.merriam-webster.com/dictionary/resister (Year: 2023).*

(Continued)

*Primary Examiner* — David Carroll
(74) *Attorney, Agent, or Firm* — CANTOR COLBURN LLP

(57) ABSTRACT

A backup including a resister articulated to a mounting ring, a support articulated to a support ring and the resister, the resister moving upon one of the mounting ring and the support ring moving away from the other. A seal including a mandrel, an element and a backup disposed on the mandrel adjacent the element. A borehole system including a borehole in a formation, a string in the borehole, a backup disposed within or as a part of the string. A backup including a deformable ring, a resister disposed adjacent the deformable ring, the resister being articulated to a ring mount through a pivot pin having a frustoconical geometry. A backup including a resister articulated to a ring, the resister including a borehole wall engager. A borehole system including a borehole in a subsurface formation, a string in the borehole, a backup within or as a part of the string.

19 Claims, 9 Drawing Sheets

(56) References Cited

U.S. PATENT DOCUMENTS

| | | | | |
|---|---|---|---|---|
| 2011/0187168 | A1* | 8/2011 | Zorine | B60N 2/3013 29/428 |
| 2013/0319654 | A1* | 12/2013 | Hiorth | E21B 33/128 166/179 |
| 2014/0116680 | A1 | 5/2014 | Mercer et al. | |
| 2014/0353038 | A1* | 12/2014 | De Mul | F27D 3/12 175/52 |
| 2018/0245423 | A1* | 8/2018 | Stormo | E21B 33/1293 |
| 2018/0252068 | A1 | 9/2018 | Murphy | |
| 2019/0120011 | A1* | 4/2019 | Kellner | E21B 33/1216 |
| 2019/0323316 | A1* | 10/2019 | Brown | E21B 33/1216 |
| 2021/0071496 | A1 | 3/2021 | Brown et al. | |

OTHER PUBLICATIONS

Merriam Webster engager https://www.merriam-webster.com/dictionary/engager (Year: 2023).*

Merriam Webster Support https://www.merriam-webster.com/dictionary/Support (Year: 2023).*

Masson, Graham, "High Expansion Technology Opens the Way for Enhanced Recovery", SPE/AAPG Africa Energy and Technology Conference, Dec. 5, 2016; 4 pages.

Interwell High Expansion Bridge Plug-HEX, Vimeo video: https://vimeo.com/47654146 Retrieved from the internet Jan. 12, 2024.

Notification of Transmittal of the International Search Report and the Written Opinion of the International Searching Authority, or the Declaration; PCT/US2023/013122; Mail Date: Jun. 1, 2023: 11 pages.

* cited by examiner

HIGH EXPANSION BACKUP, SEAL, AND SYSTEM

BACKGROUND

In the resource recovery and fluid sequestration industries seals are prevalent required apparatus. A common concern for many types of seals is swab off due to pressure differentials that cause more axial shear forces than can be withstood by an element. Accordingly, elements are often backed up by configurations that are unsurprisingly known as "back ups". Back ups have been used for some time and can be effective for some operations but all backups are application specific to some degree in that they may work well in some applications and less well in other applications. The art has created many different types of backups for this reason but still there are applications in which currently known backups are insufficient particularly where differential pressures are exceptionally high. The art would well receive alternatives that expand the types of applications for which reliable sealing may be achieved.

SUMMARY

An embodiment of a backup including a resister articulated to a mounting ring, a support articulated to a support ring and articulated to the resister, the resister moving to a larger diameter position upon one of the mounting ring and the support ring moving away from the other of the mounting ring and the support ring.

An embodiment of a seal including a mandrel, an element on the mandrel, a backup disposed on the mandrel adjacent the element.

An embodiment of a borehole system including a borehole in a subsurface formation, a string in the borehole, a backup disposed within or as a part of the string.

An embodiment of a backup including a deformable ring, a resister disposed adjacent the deformable ring, the resister being articulated to a ring mount through a pivot pin having a frustoconical geometry.

An embodiment of a borehole system including a borehole in a subsurface formation, a string in the borehole, a backup disposed within or as a part of the string.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
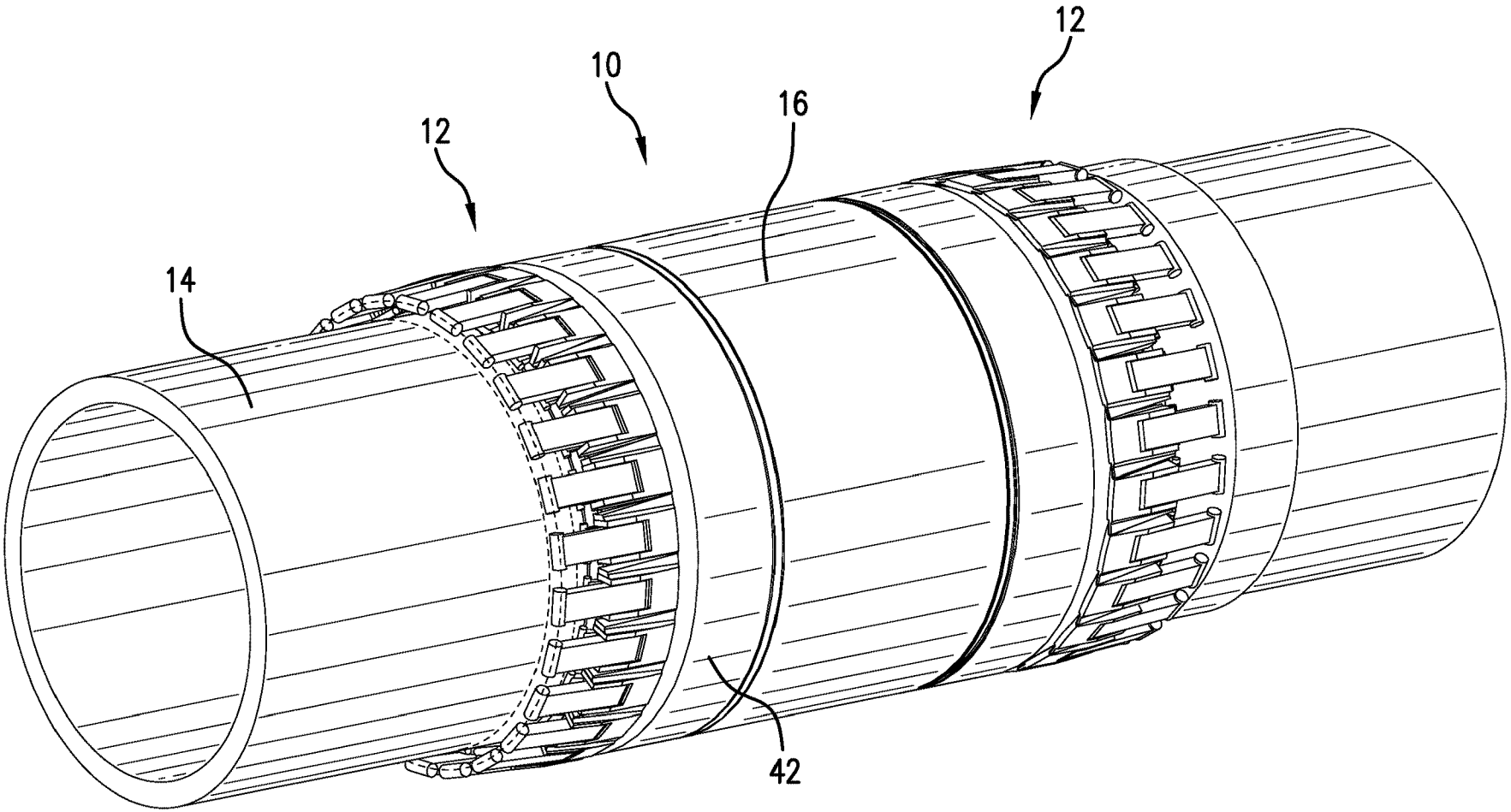
FIG. 1 is a perspective view of a seal having a backup as disclosed herein.
Figure 2:
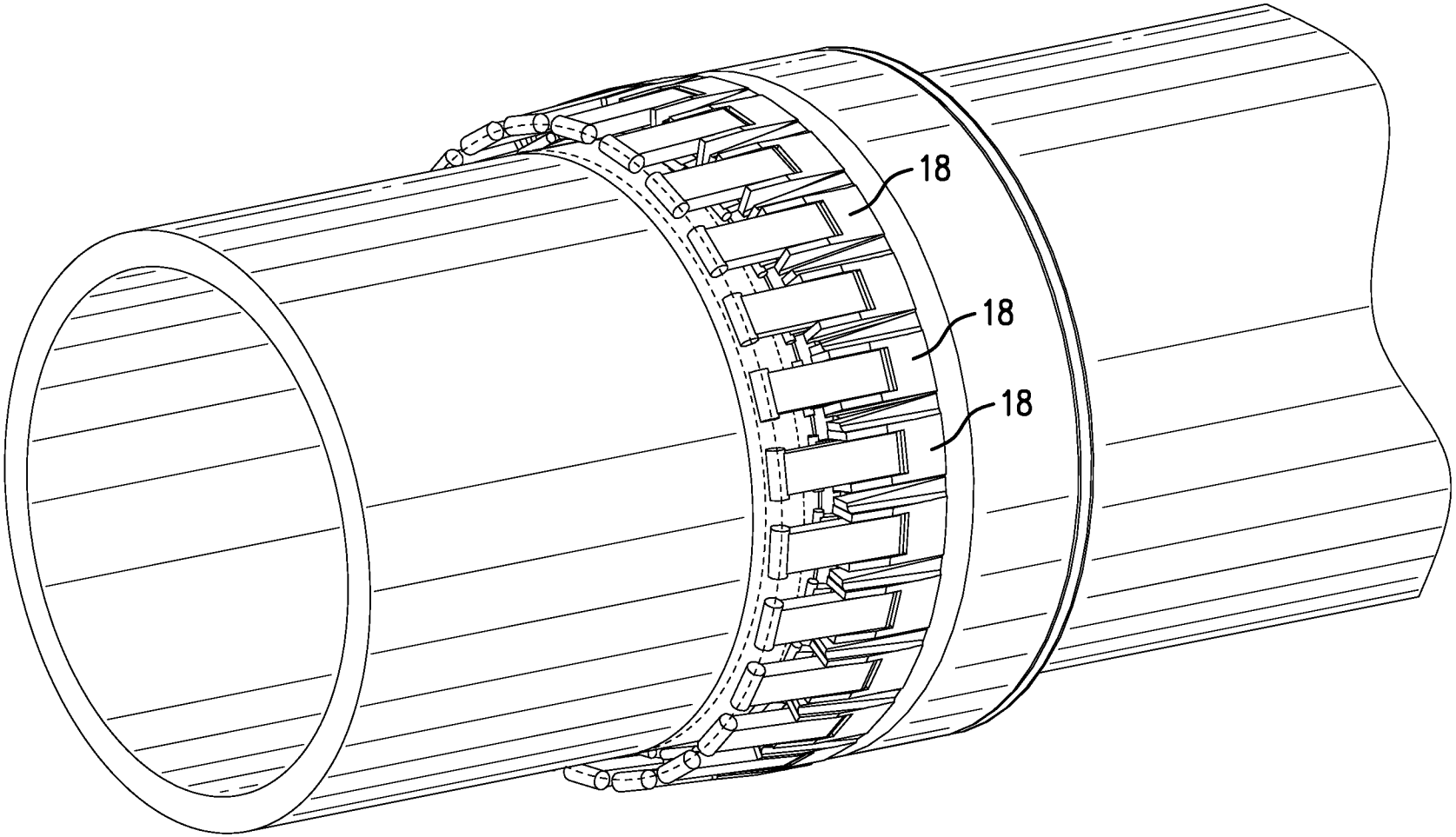
FIGS. 2 and 3 are an enlarged view of a portion of FIG. 1 focused on the backup in a run in and deployed position, respectively.
Figure 3:
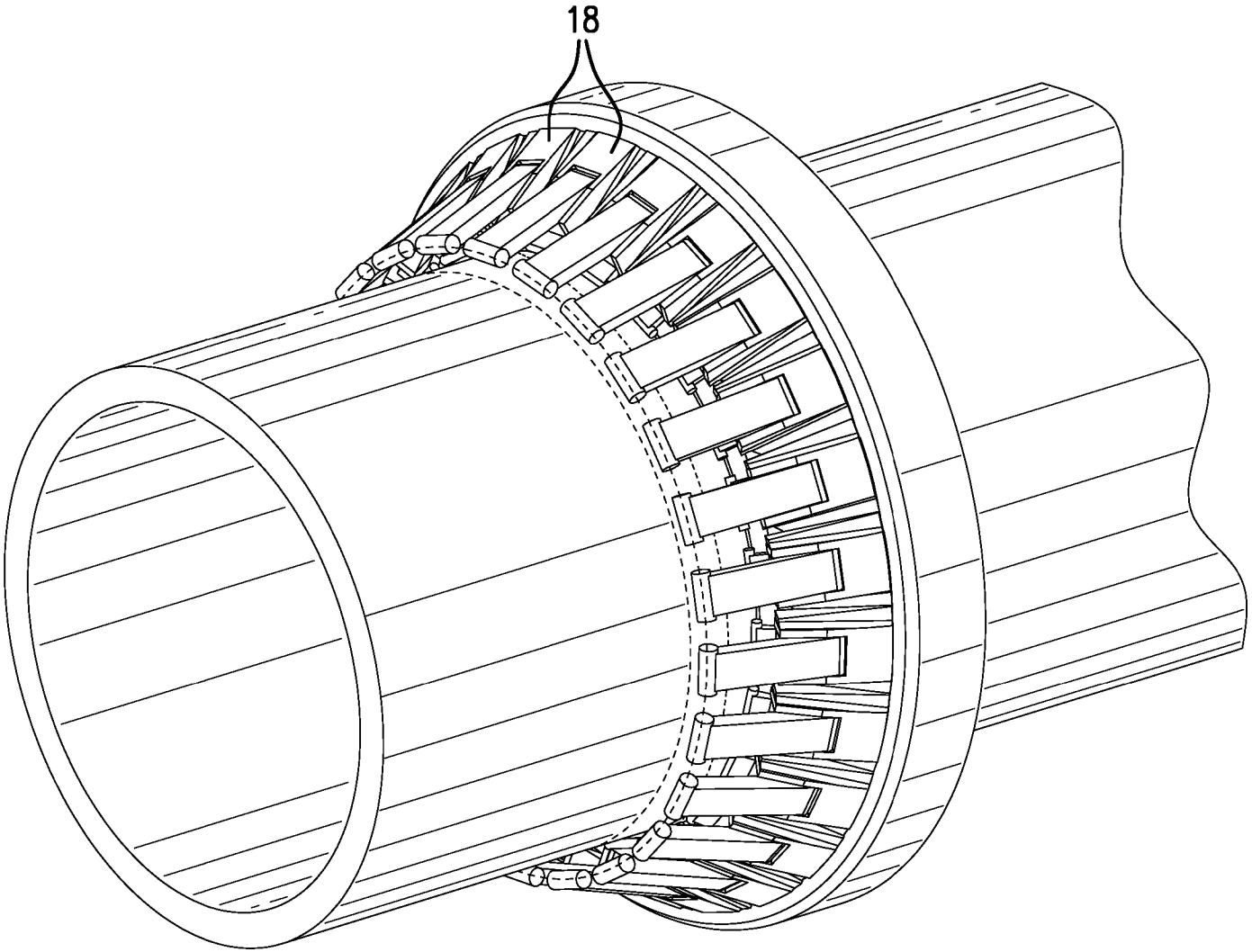

Referring to FIG. 1, a seal 10 is illustrated that includes a backup 12. Seal 10 comprises a mandrel 14 upon which is disposed an element 16 and adjacent which element is a backup 12. The backup 12 is configured for exceptionally high pressure differentials such as a 5000 psi differential or even higher across the seal 10 when employing the backup 12. Reference is made to FIGS. 2 and 3 which show a run in position (FIG. 2) and a deployed position (FIG. 3).

Figure 4:
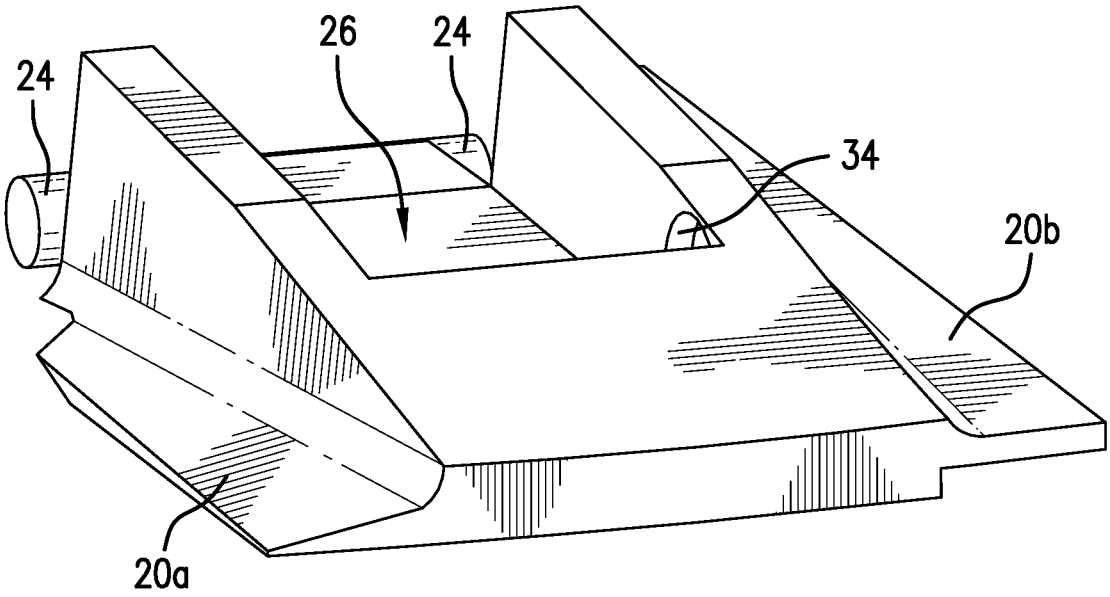
FIG. 4 is a perspective view of one embodiment of a resister as disclosed herein.
Figure 5:
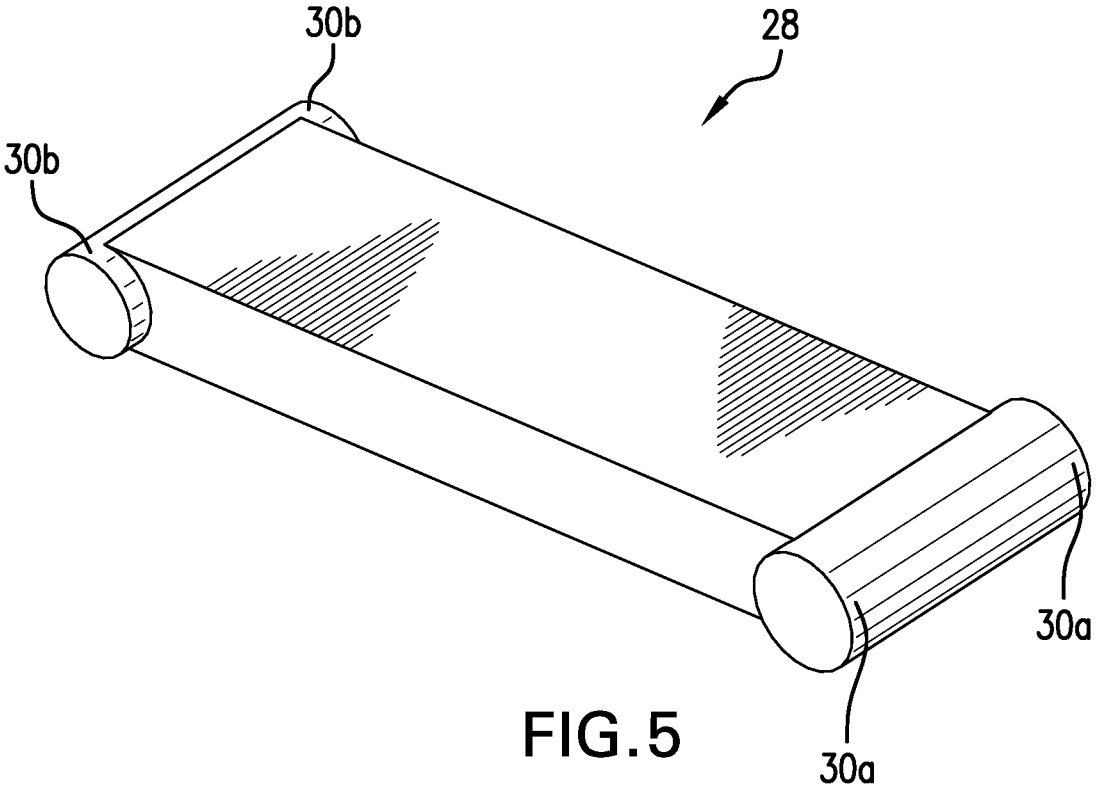
FIG. 5 is a perspective view of a support as disclosed herein.
Figure 6:
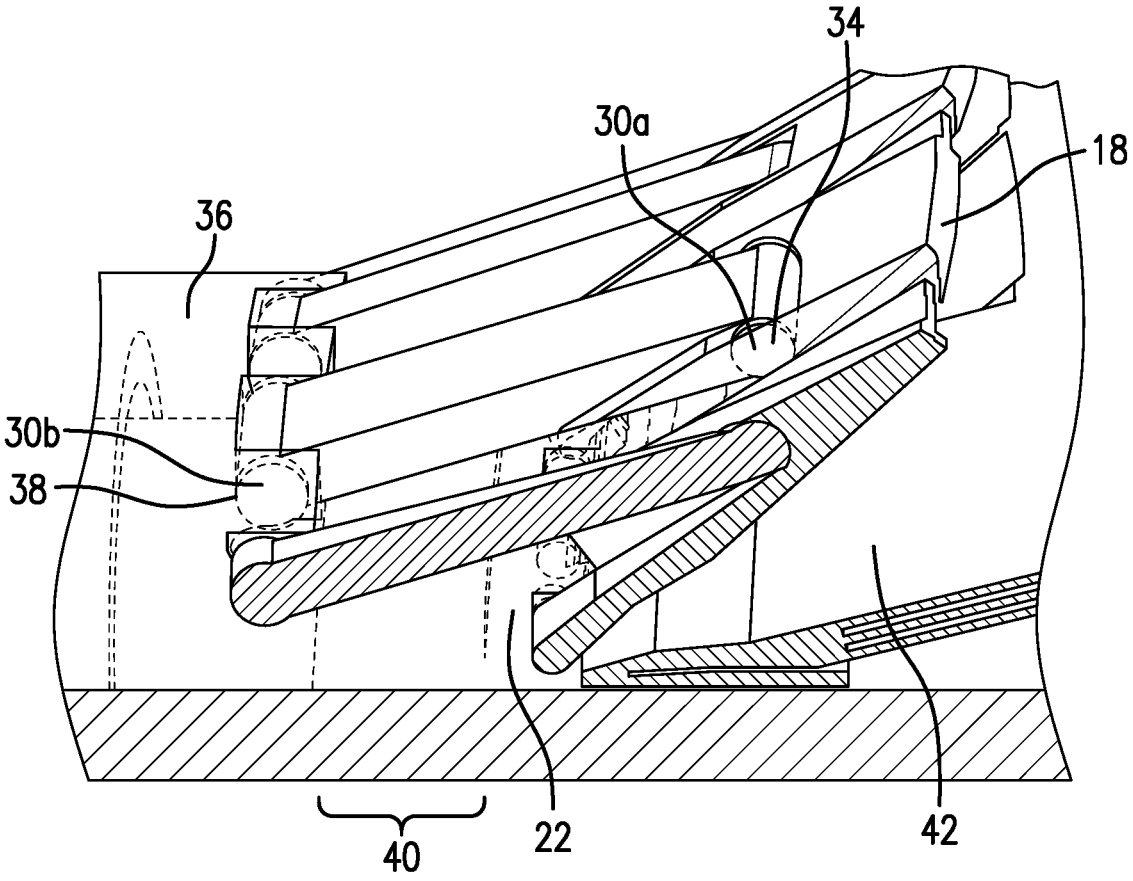
FIG. 6 is an enlarged partial cross-sectional view of the embodiment of FIG. 1.

Back up 12 includes a series of resisters 18, one shown individually in FIG. 4, that are positioned about the seal 10. In embodiments, the resisters 18 include one or more wings 20*a*, 20*b* that facilitate overlapping of adjacent resisters 18 even in the deployed position of FIG. 3, to improve swab resistance. Referring now to FIGS. 3, 4 and 6 (wherein one of the resisters 18 is illustrated transparently), the resister 18 is articulated to a mounting ring 22 at pivot points 24. Upon pivots 24, the resister 18 may swing from the run in position of FIG. 2, to the deployed position of FIG. 3. Resister 18 further includes a groove 26 to receive a support 28 (FIG. 5). The support 28 includes pivot nubs 30*a* at one end of support 28 and pivot nubs 30*b* at an opposite end of support 28. Pivot nubs 30*a* are receivable in pivot notches 34 in resister 18. Pivot nubs 30*b* on the other hand are connected to support ring 36 at pivot notches 38. It is important to note distance 40 between mounting ring 22 and support ring 36 in FIG. 6. This distance is different in the run in position and the deployed position (as shown). Specifically, the run in distance would be shorter than the distance illustrated in FIG. 6. When deploying the backup 12, the support ring and mounting ring are moved to be farther from each other on the mandrel 14. This is what allows the resisters 18 to splay outwardly. Were the rings 22 and 36 fixed in position, the resisters 18 could not move. A review of the pivot points seen in FIG. 6 will confirm this for the reader. In the embodiment illustrated, both rings 22 36 move on the mandrel during setting but at the same time, the rings also move away from each other based upon the pressure acting on the backup 12 from the element 16.

In addition to the foregoing, the seal 10 may also include a deformable petal type backup ring or a solid thin continuous ring 42 which would look the same as one layer of the petal rings without the gaps that is positioned between backup 12 and element 14. The backup ring 42 adds strength and extrusion resistance. These can be used together or backup 12 may be used alone. It will be appreciated from FIG. 3 that extrusion resistance is still good with backup 12 alone due to the wings 20*a* and 20*b*.

Figure 7:
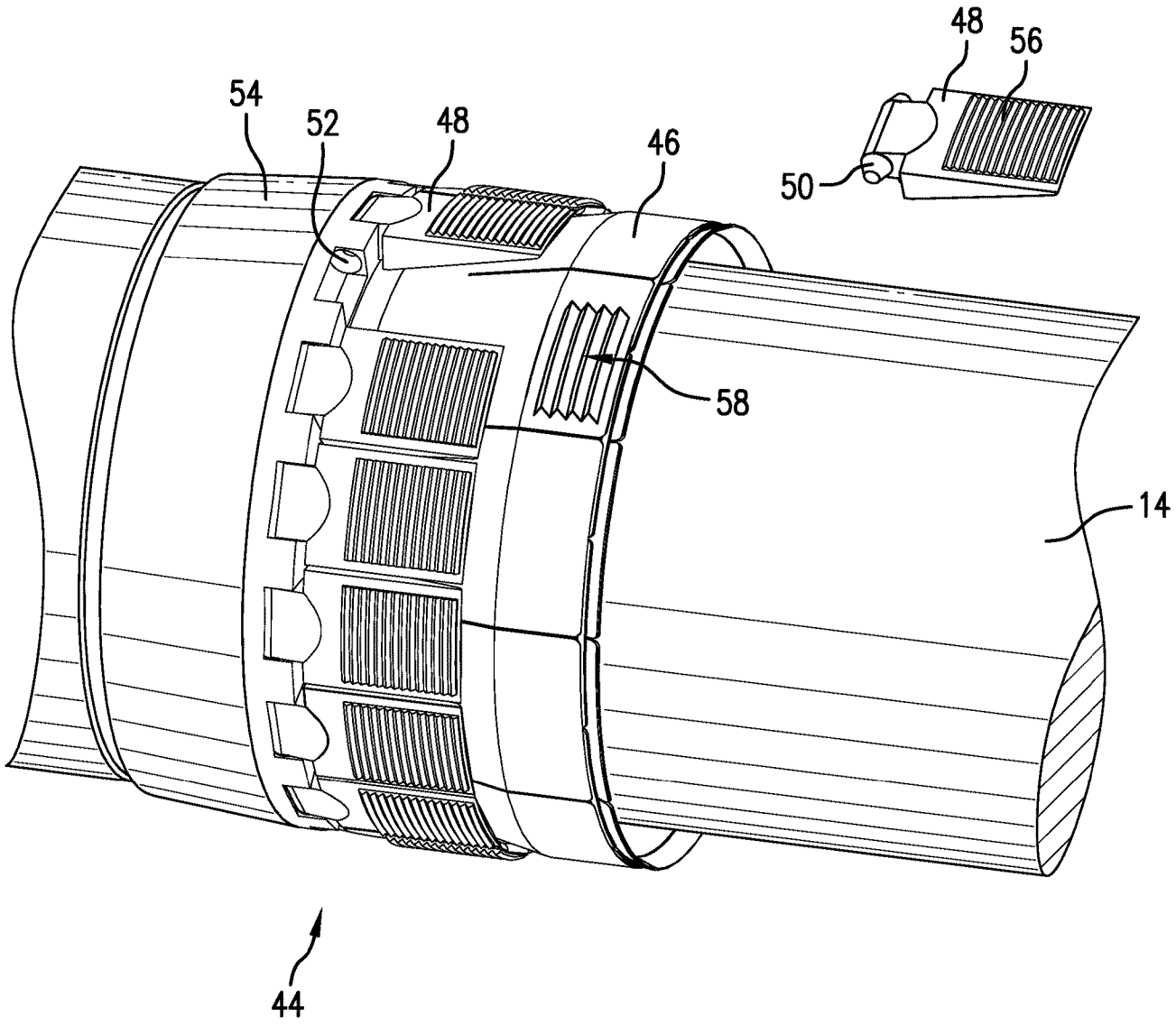
FIG. 7 is a perspective view of another embodiment of a backup as disclosed herein.

In another embodiment of backup 44, referring to FIG. 7, a deformable petal ring or a solid thin continuous ring 46 which would look the same as one layer of the petal rings without the gaps is disposed upon mandrel 14 adjacent a ring of resisters 48 having pivot nubs 50 that are frustoconically shaped. The frustoconically shaped nubs 50 are received in frustoconical notches 52 in a ring mount 54. The frustoconical geometry of the nubs and notches provides dramatically increased resistance to failure such that the resisters are well configured to resist 5000 psi differential pressure or higher. It will be understood by those familiar with the art that an element is omitted from the Figure but that it would be adjacent ring 46 and about the mandrel 14 similar to that which is illustrated in FIG. 1

It will also be appreciated from FIG. 7 that resisters 48 and/or ring 46 include a wall engager 56 and/or 58, that may be wickers thereon, that is configured to engage an inside diameter surface 60 (see FIG. 8) of a borehole or tubular string when deployed. This engagement will help to anchor the backup. Such wickers are contemplated for each embodiment disclosed herein.

Figure 8:
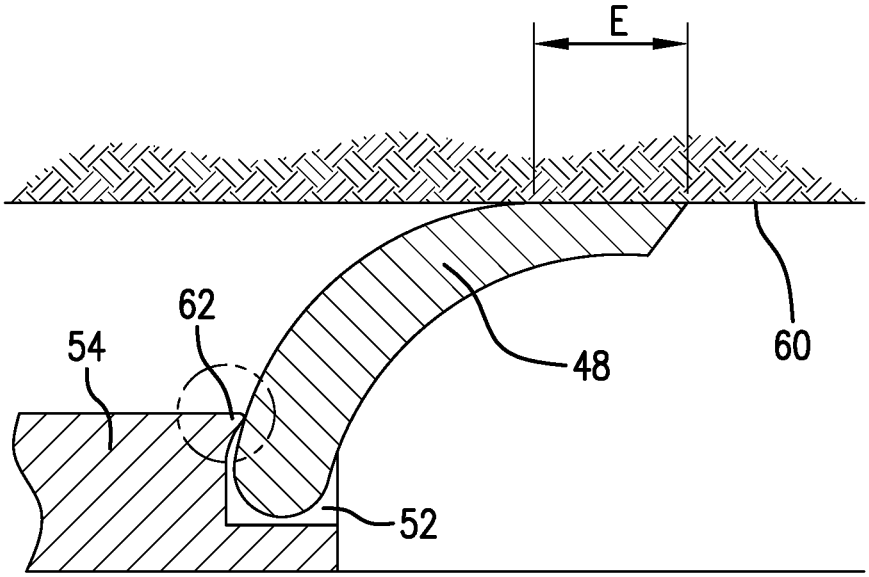
FIG. 8 is a cross section view of an embodiment of a resistor-resister in a deployed position.

In embodiments, referring to FIG. 8, the resister will plastically deform as well as articulate. In such embodiments, the material of the resister 48 may be 30 ksi steel while ring mount 54 may comprise 1.25 ksi steel. The shape as illustrated in FIG. 8 is desirable to create a contact patch with the inside diameter 60 of between about ⅓ the length of the resister 48 to of the length of the resister 48 the length being considered as if the resister was laid in parallel to a longitudinal extent of the seal 10 before deformation and measured in that condition. Therefore about ⅓ to ½ A of the total length of the resister 48 would be in contact with ID 60 when in the deployed position. This is identified as length E in FIG. 8. It will be appreciated that the resister 48 illustrated may include or not include the wall engager 56.

Also to be appreciated from FIG. 8 is a back stop 62 between the resister 48 and the ring mount 54. The back stop 62 assists in providing back support to the system increasing differential pressure ratings.

Figure 9:
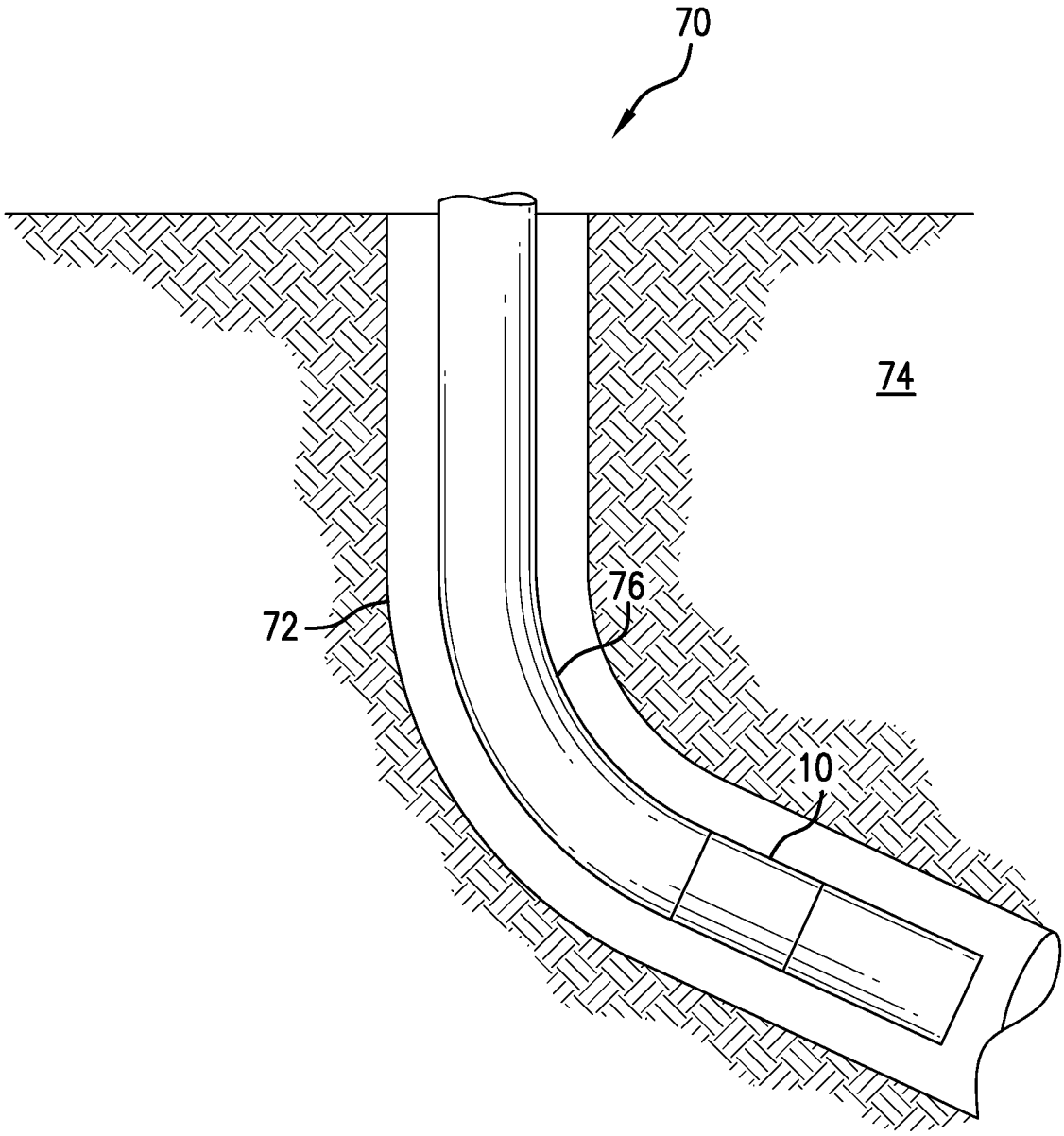
FIG. 9 is a view of a borehole system including the backup disclosed herein.

Referring to FIG. 9, a borehole system 70 is illustrated. The system 70 includes a borehole 72 in a subsurface formation 74. Within the borehole 72 is a string 76. Disposed within or as a part of the string 76 is a backup 12 or 44 that may be a part of a seal 10.

Set forth below are some embodiments of the foregoing disclosure:

Embodiment 1: A backup including a resister articulated to a mounting ring, a support articulated to a support ring and articulated to the resister, the resister moving to a larger diameter position upon one of the mounting ring and the support ring moving away from the other of the mounting ring and the support ring.

Embodiment 2: The backup as in previous embodiment wherein the resister includes a first wing configured to overlap an adjacent resister.

Embodiment 3: The backup as in previous embodiment wherein the resister includes a second wing extending in an opposite direction to that of the first wing.

Embodiment 4: The backup as in previous embodiment wherein the support is articulated to the resister between the articulation to the mounting ring and an end of the resister that defines a radially largest diameter of the resister when fully deployed.

Embodiment 5: The backup as in previous embodiment wherein the resister includes a groove into which the support is received.

Embodiment 6: The backup as in previous embodiment wherein the groove is closed radially inwardly of a radius defined by a fully deployed resister.

Embodiment 7: A seal including a mandrel, an element on the mandrel, a backup as in previous embodiment disposed on the mandrel adjacent the element.

Embodiment 8: A borehole system including a borehole in a subsurface formation, a string in the borehole, a backup as in previous embodiment disposed within or as a part of the string.

Embodiment 9: A backup including a deformable ring, a resister disposed adjacent the deformable ring, the resister being articulated to a ring mount through a pivot pin having a frustoconical geometry.

Embodiment 10: The backup as in previous embodiment wherein the ring mount provides a backstop to the resister at a fully deployed position.

Embodiment 11: The backup as in previous embodiment wherein the resister is wedge shaped.

Embodiment 12: The backup as in previous embodiment wherein the resister and/or the deformable ring further includes a borehole wall engager.

Embodiment 13: The backup as in previous embodiment wherein the engager is an anchor.

Embodiment 14: The backup as in previous embodiment wherein the engager is a wicker.

Embodiment 15: A backup including a resister articulated to a ring, the resister including at an end thereof opposite the end articulated to the ring, a borehole wall engager.

Embodiment 16: The backup as in previous embodiment wherein the engager is an anchor.

Embodiment 17: The backup as in previous embodiment wherein the engager is a wicker.

Embodiment 18: A borehole system including a borehole in a subsurface formation, a string in the borehole, a backup as in previous embodiment disposed within or as a part of the string.

Embodiment 19: The system as in previous embodiment wherein the resister when deployed is in contact with the borehole or string over about ⅓ to about ½ of the longitudinal length of the resister.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" can include a range of ±8% or 5%, or 2% of a given value.

The teachings of the present disclosure may be used in a variety of well operations. These operations may involve using one or more treatment agents to treat a formation, the fluids resident in a formation, a borehole, and/or equipment in the borehole, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A backup for a seal comprising:

a resister articulated to a mounting ring;

a support articulated to a support ring and articulated to the resister, the resister moving to a larger diameter position upon one of the mounting ring and the support ring moving away from the other of the mounting ring and the support ring.

2. The backup as claimed in claim 1 wherein the resister includes a first wing configured to overlap an adjacent resister.

3. The backup as claimed in claim 2 wherein the resister includes a second wing extending in an opposite direction to that of the first wing.

4. The backup as claimed in claim 1 wherein the support is articulated to the resister between the articulation to the mounting ring and an end of the resister that defines a radially largest diameter of the resister when fully deployed.

5. The backup as claimed in claim 1 wherein the resister includes a groove into which the support is received.

6. The backup as claimed in claim 5 wherein the groove is closed radially inwardly of a radius defined by a fully deployed resister.

7. A seal comprising:

a mandrel;

an element on the mandrel;

a backup as claimed in claim 1 disposed on the mandrel adjacent the element.

8. A borehole system comprising:

a borehole in a subsurface formation;

a string in the borehole;

a backup as claimed in claim 1 disposed within or as a part of the string.

9. A backup for a wellbore tool comprising:

a deformable ring;

a resister disposed adjacent the deformable ring, the resister being articulated to a ring mount through a pivot pin that is frustoconical in geometry engaging notches that are frustoconical in geometry.

10. The backup as claimed in claim 9 wherein the ring mount provides a backstop to the resister at a fully deployed position.

11. The backup as claimed in claim 9 wherein the resister is wedge shaped.

12. The backup as claimed in claim 9 wherein the resister and/or the deformable ring further includes a borehole wall engager.

13. The backup as claimed in claim 12 wherein the engager is an anchor.

14. The backup as claimed in claim 12 wherein the engager is a wicker.

15. A backup comprising:

a resister articulated to a ring mount through a pivot pin that is frustoconical in geometry engaging notches that are frustoconical in geometry, the resister including at an end thereof opposite the end articulated to the ring, a borehole wall engager.

16. The backup as claimed in claim 15 wherein the engager is an anchor.

17. The backup as claimed in claim 15 wherein the engager is a wicker.

18. A borehole system comprising:

a borehole in a subsurface formation;

a string in the borehole;

a backup as claimed in claim 9 disposed within or as a part of the string.

19. The system as claimed in claim 18 wherein the resister when deployed is in contact with the borehole or string over about ⅓ to about ½ of the longitudinal length of the resister.

* * * * *